US005197390A

United States Patent [19]

Richardson

[11] Patent Number: 5,197,390

[45] Date of Patent: Mar. 30, 1993

[54] SUSPENDED VEHICLE WITH ORIENTATION ADJUSTMENT BY HORIZONTALLY TRANSLATING THE PIVOT POINT RELATIVE TO THE VERTICAL AXIS

[75] Inventor: Lyman Richardson, Thornhill, Canada

[73] Assignee: Transyt Canada Inc., Concord, Canada

[21] Appl. No.: 828,302

[22] Filed: Jan. 30, 1992

[51] Int. Cl.[5] ..... B61B 3/00

[52] U.S. Cl. ..... 105/149.1; 198/680

[58] Field of Search ..... 105/148, 149, 150; 104/89; 198/797, 680

[56] References Cited

U.S. PATENT DOCUMENTS

| | | | |
|---|---|---|---|
| 1,947,119 | 2/1934 | Walter | 105/141 |
| 3,525,306 | 8/1970 | Edel | 105/149 X |
| 3,543,687 | 12/1970 | Ellzey | 105/149 X |

FOREIGN PATENT DOCUMENTS

| | | | |
|---|---|---|---|
| 2438570 | 2/1976 | Fed. Rep. of Germany | 105/148 |
| 706269 | 12/1979 | U.S.S.R. | 105/149 |
| 742212 | 6/1980 | U.S.S.R. | 105/149 |
| 787223 | 12/1980 | U.S.S.R. | 105/149 |

OTHER PUBLICATIONS

"Washington Metro Automated by General Railway Signal" brochure, GRS Co., Apr. 1981.

*Primary Examiner*—Robert J. Oberleitner
*Assistant Examiner*—S. Joseph Morano
*Attorney, Agent, or Firm*—Mirek A. Waraksa

[57] ABSTRACT

A vehicle includes a carriage suspended with wheels from an overhead track. A suspension mechanism supports a passenger or cargo car from the carriage. The suspension mechanism includes horizontal pivot joint that allows the car to swing about a horizontal axis when traversing bends. A sliding connection between the car and the pivot joint permits the car to displace horizontally relative to the pivot axis. A motor rotates a screw thread mechanism to produce such displacement. A sensor detects inclination of the car relative to vertical in response to uneven weight distribution or wind forces, but is not responsive to centrifugal forces and normal swinging of the car at bends. The sensed inclination of the car may be displayed on a monitor, and controls permit the motor to be actuated to displace the car in a direction in which gravity applies a torque to the car that reduces undesired inclination.

8 Claims, 5 Drawing Sheets

SUSPENDED VEHICLE WITH ORIENTATION ADJUSTMENT BY HORIZONTALLY TRANSLATING THE PIVOT POINT RELATIVE TO THE VERTICAL AXIS

FIELD OF THE INVENTION

The invention relates to vehicles that travel suspended from overhead tracks.

BACKGROUND OF THE INVENTION

Suspended vehicles of the monorail-type and others are known. Wheeled carriages commonly referred to as "bogies" support a cargo or passenger car from an overhead track. To accommodate movement around bends, it is desirable to form a pivot joint between each bogie and the car, allowing centrifugal forces to pivot the car until a balanced orientation is achieved. Two problem arise. First, a non-even distribution of cargo or passengers can incline the car relative to horizontal. Second, wind forces may cause the car to sway about the pivot joint. Both effects are dissettling to passengers, producing lateral forces that tend to topple them. Cargo also tends to displace.

The car can be rigidly fixed to a bogie to resist changes in orientation in response to weight distribution and wind effects. This is particularly applicable to vehicles suspended by paired wheels running on dual spaced-apart rails. However, this prevents natural and acceptable pivoting in response to centrifugal forces. When traversing bends, passengers once again experience unpleasant lateral forces and items of cargo tend to displace. The operating speed of such a vehicle may have to be restricted.

The present invention addresses the foregoing problems.

SUMMARY OF THE INVENTION

In one aspect, the invention provides a vehicle adapted for travel suspended below an overhead track. The vehicle includes a carriage and means mounting the carriage to the track for travel with the carriage suspended below the track. The vehicle also includes a container (appropriate for passengers or cargo) and suspension means for suspending the container from the carriage. The suspension means include a pivot joint connecting the container to the carriage such that the container pivots about a generally horizontal pivot axis that aligns with the direction of an immediately overhead portion of the track. The pivot joint includes means securing the container to the pivot joint and permitting horizontal translation of the container transverse relative to the pivot axis. The term "horizontal translation" and comparable expressions in this specification should be understood in a mathematical sense, namely, as a displacement of an object in which the horizontal coordinate of each point on the object is incremented or decremented by the same amount. Controllable displacing means permit displacement of the container selectively in opposing horizontal directions relative to the pivot axis. The displacing means cooperate with the connecting means during such displacement to translate the container horizontally and transversely relative to the pivot axis. This permits the effect of gravity on the centre of gravity of the car and its contents to be exploited to apply a torque to the car to compensate for uneven weight distribution or sway in response to high winds. The term "sway" is used in this specification in contradistinction to "swing". "Swing" is regarded as an outward pivoting in response to centrifugal forces at bends in a track. "Sway" is regarded as a comparable pivoting, but produced by wind forces.

The position of the container relative to the horizontal pivot axis is preferably controlled in response to a level sensing means indicating the orientation of the container relative to vertical. The sensing means preferably discriminate between displacement of the centre of gravity of the container and its contents in response to centrifugal forces and changes in inclination responsive either to uneven weight distribution or swaying of the vehicle in response to wind forces. Controls may displace the container relative the pivot joint in a direction that reduces the inclination of the car relative to vertical in response to the sensed inclination. The controls may be entirely automatic, but may alternatively provide a visual display of the angle of inclination (independent of centrifugal forces) and may permit manual actuation of the displacing means.

Various aspects of the invention will be apparent from a description below of a preferred embodiment and will be more specifically defined in the appended claims.

DESCRIPTION OF THE DRAWINGS

The invention will be better understood with reference to drawings illustrating a preferred embodiment, in which.

DESCRIPTION OF PREFERRED EMBODIMENT

Figure 1:
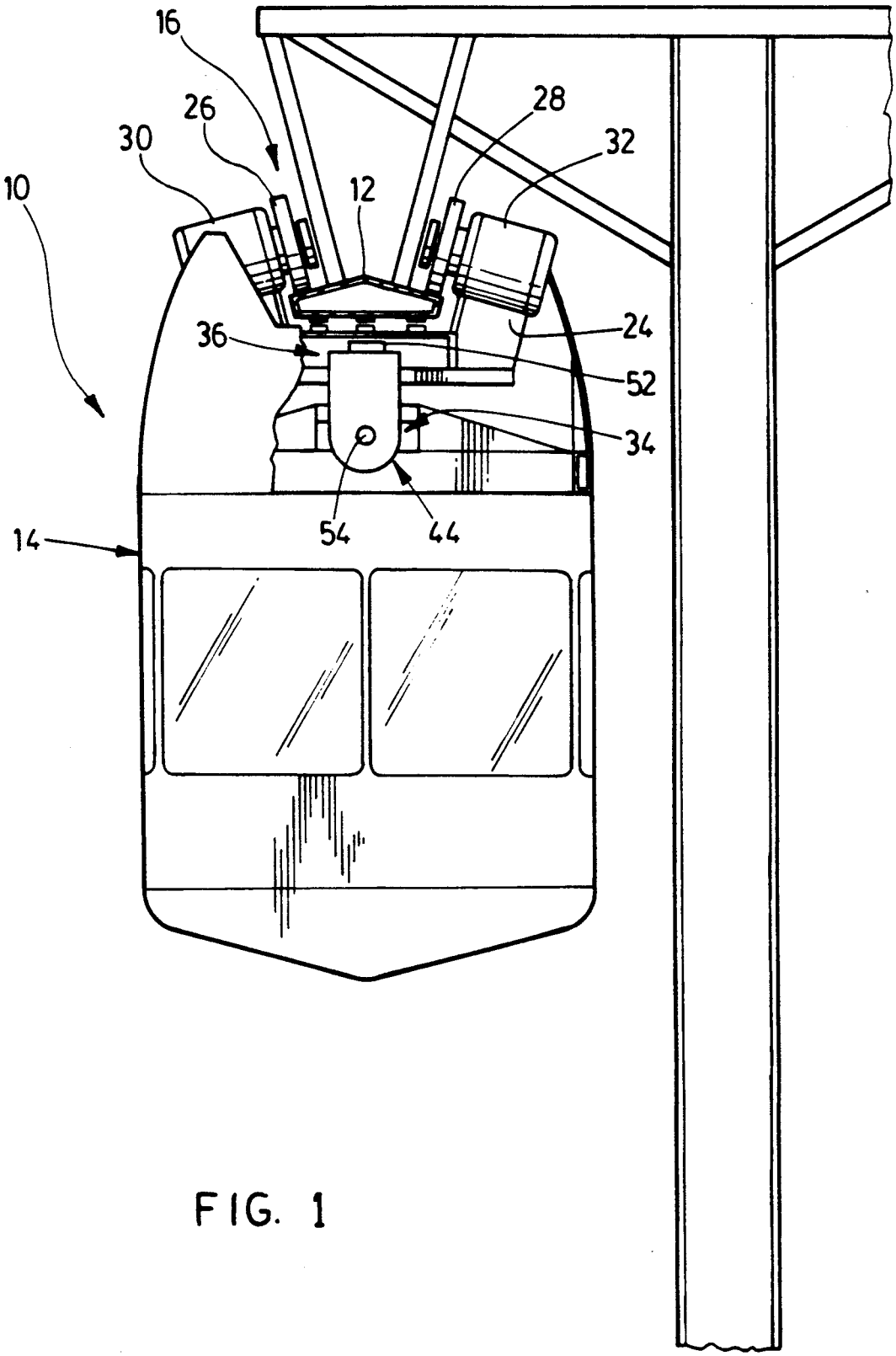
FIG. 1 is a fragmented elevational view showing a vehicle suspended from an overhead track.

Reference is made to FIG. 1 which illustrates a vehicle 10 suspended from an overhead track 12. Only major components of the vehicle 10 have been numbered in FIG. 1 to avoid obscuring the drawing. The vehicle 10 comprises a container or car 14 adapted to carry passengers. The container is suspended by identical forward and rear carriages, only the forward carriage 16 being illustrated. These carriages are adapted to travel along the track 12 while themselves being suspended largely below the track 12. The track 12 carries power lines 18, 20 and a communication line 22 required for vehicle operation (numbered in FIG. 2 only). Standard sliding contacts are used to couple the vehicle 10 to the power and communication lines 18–22 and will not be described.

Figure 2:
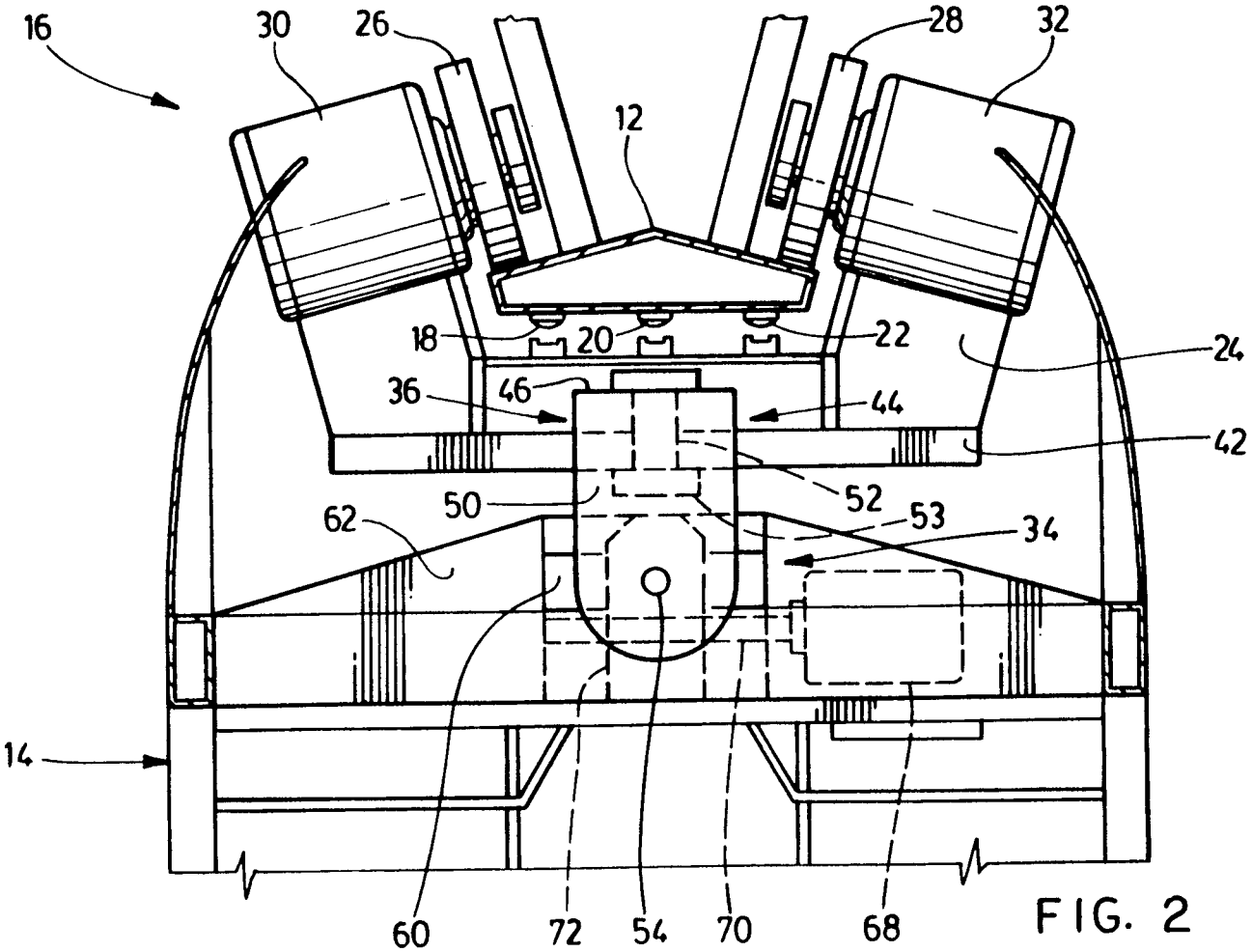
FIG. 2 is an fragmented elevational view detailing one carriage used to suspend the vehicle from the track.

The forward carriage 16 is further detailed in FIG. 2. It comprises a steel frame 24 that supports a first pair of wheels 26, 28 and a first pair of electric motors 30, 32 that separately rotate the wheel 26, 28. The frame 24 positions one wheel 26 to ride on one side of the track 12 and the other wheel 28 to ride on an opposite side. A second pair of wheels and second pair of motors are identically oriented on the steel frame 24 rearwardly of the first wheel pair 26, 28 and the first motor pair 30, 32, but have not been illustrated. This suspends the carriage 16 and permits its travel along the track 12. Appropriate construction will apparent to those skilled in the art.

Figure 3:
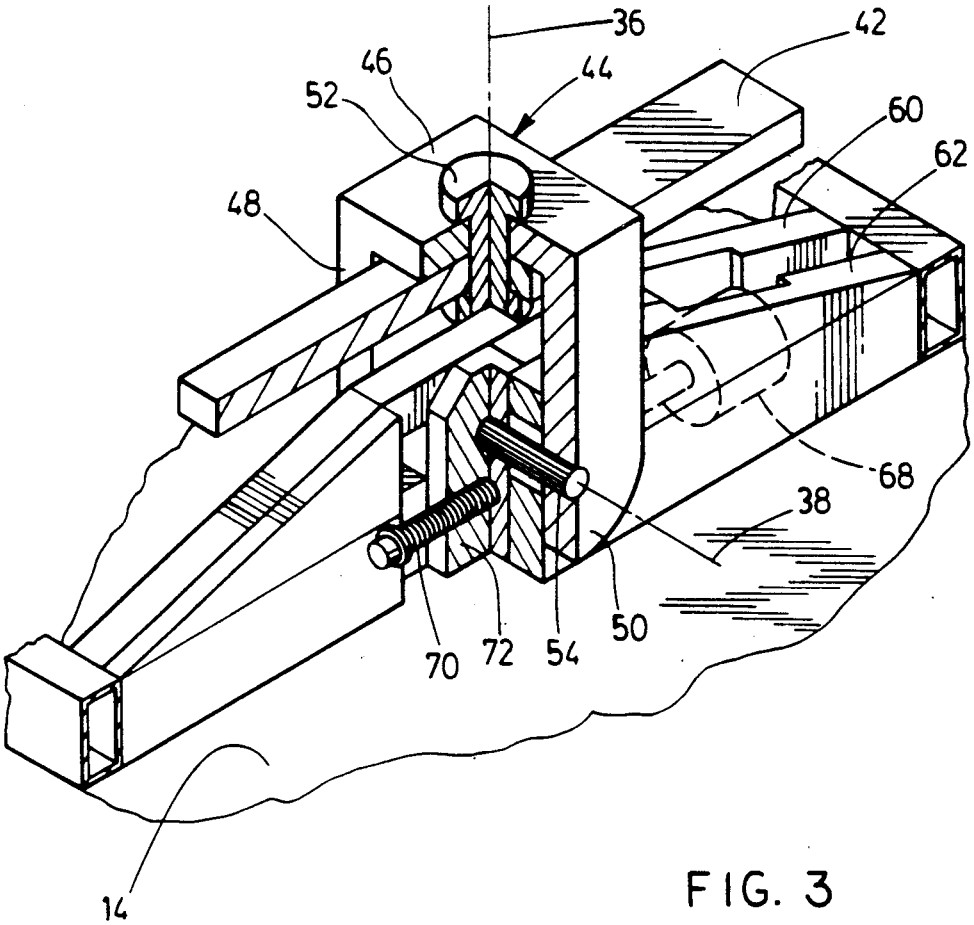
FIG. 3 is a fragmented perspective view of a suspension mechanism connecting a car to the carriage and including a motorized mechanism for controlling the position of the car.
Figure 4:
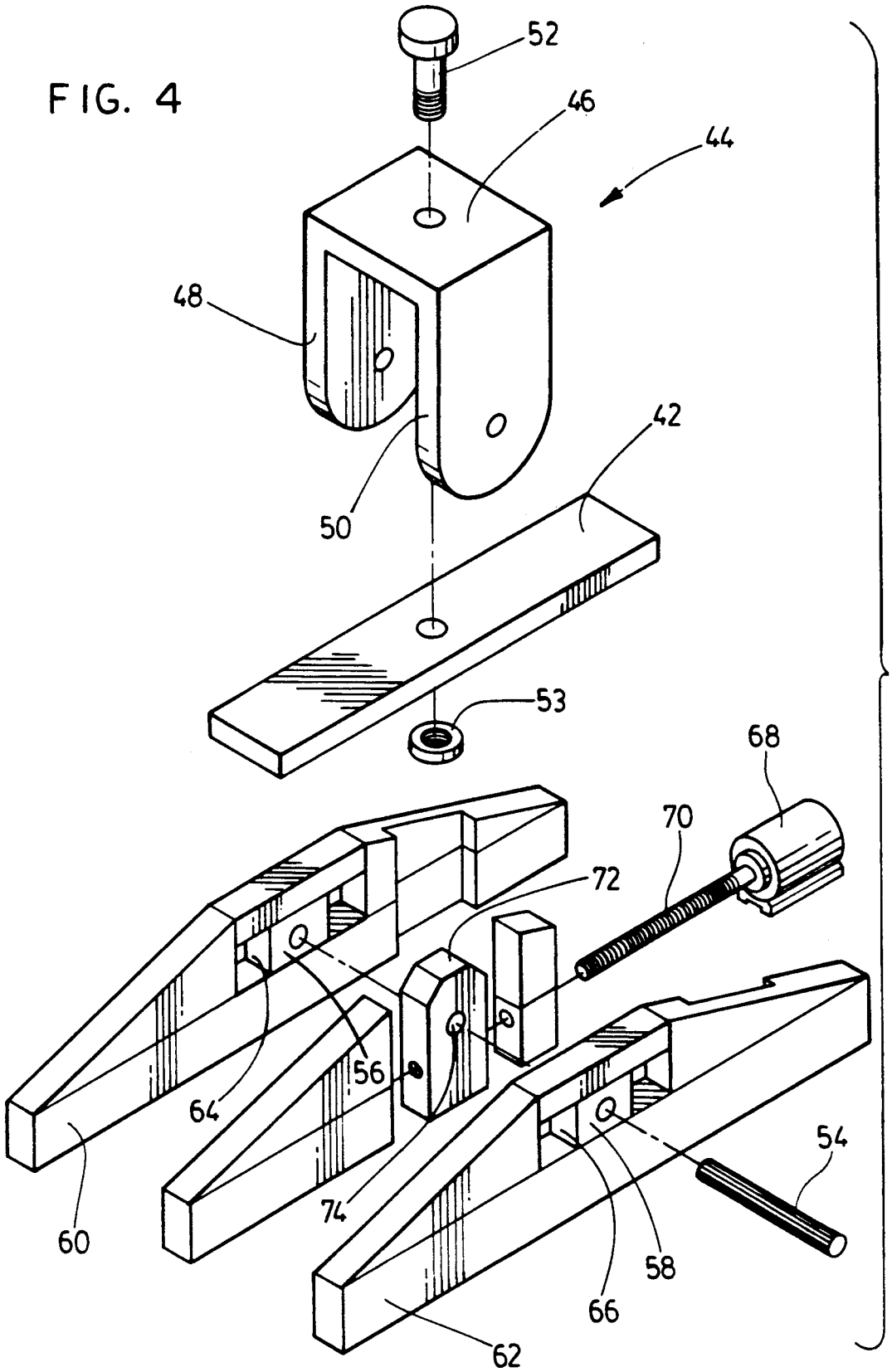
FIG. 4 is an exploded perspective view further detailing the suspension mechanism.

A unique suspension mechanism which supports the car 14 from the carriage 16 is detailed in FIGS. 3 and 4. The suspension mechanism comprises horizontal and vertical pivot joints, generally indicated by reference numerals 34, 36. These joints 34, 36 are connected essentially in series to permit pivoting of the car 14 about both a generally horizontal axis 38 that is normally aligned with an immediately overhead portion of the track 12 and a generally vertical axis 40, both axes being illustrated in FIG. 3. Pivoting about the vertical axis 40 allows the vehicle 10 to negotiate bends in the track 12 (forward and rear carriages aligning as required). Pivoting about the horizontal axis 38 is intended to accommodate centrifugal forces at track bends, allowing the car 14 to swing.

The suspension mechanism includes a horizontal box beam 42 that is rigidly fixed to and supported by the carriage 16. A clevis 44 comprises a base 46 and a pair of opposing parallel arms 48, 50. The clevis base 46 is supported centrally on the upper surface of the beam 42. A vertical pivot pin 52, extending through the beam 40 and clevis base 46 and secured to the underside of the beam 42 with a nut 53, completes the vertical pivot joint 36. A thrust bearing (not illustrated) may be placed between the clevis base 46 and the beam 42 to facilitate relative rotation. The clevis arms 48, 50 should be spaced sufficently to either side of the beam 42 as to permit sufficient relative rotation of the beam 42 and clevis 44 to accommodate the tightest bend that occurs in the track 12.

The clevis 44 is a principal component of the horizontal pivot joint 34. The clevis arms 48, 50 are apertured to receive opposing ends of a horizontal pivot pin 54 that defines the horizontal pivot axis 38. A pair of mounting blocks 56, 58 are attached to the opposing end portions of the horizontal pivot pin 54. A pair of spaced-apart car support structures 60, 62 are fixed to the top of the car 14. Each car support structure 60 or 62 defines a horizontal slot 64 or 66 transverse to the horizontal pivot axis 38 (the slots being best illustrated and indicated in the exploded view of FIG. 4). Each slot 64 or 66 receives one of the mounting blocks 56, 58 and is shaped to permit horizontal displacement of the received mounting block 56 or 58 along the slot. Teflon TM surfaces may be provided to facilitate sliding or a rack. Alternatively, a rack and pinion rolling assembly may be substituted. This arrangement for connecting the car 14 to the horizontal pivot joint 34 not only permits the car 14 to pivot about the horizontal pivot axis 38, but also allows the car 14 to translate horizontally relative to the pivot axis 38.

An electric motor 68 provides the necessary motive power to displace the car 14 relative to the horizontal pivot axis 38. The motor 68 is attached to and rotates an elongate threaded shaft 70 oriented transverse to the pivot axis 38 and bearing-mounted to the top of the car 14. A follower 72 is threaded to the shaft 70 and displaces along the shaft 70 in response to shaft rotation. The follower 72 has a clearance hole 74 that receives the horizontal pivot pin 54. This connection secures the horizontal pivot pin 54 to the follower 72 while permitting relative rotation to allow the car 14 to pivot about the horizontal pivot axis 38. The motor 68 can be selectively actuated to rotate the shaft 70 in either angular direction thereby displacing the follower 72 selectively back and forth along the length of the shaft 70. Owing to the mounting of the shaft 70 to the car 14 and attachment of the follower 72 to the horizontal pivot pin 54, such rotation of the shaft 70 displaces the car 14 horizontally relative to the horizontal pivot axis 38, the direction of displacement an incidental horizontal translation being determined by the direction of shaft rotation.

Figure 5:
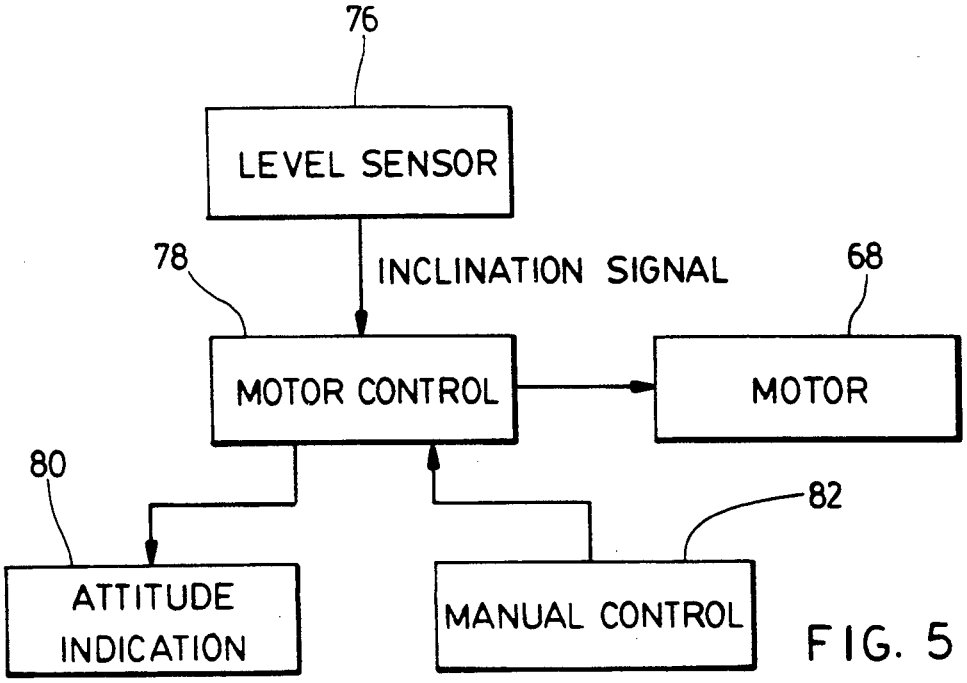
FIG. 5 is a block diagram of a control system that operates the motorized mechanism.

The control system used to regulate operation of the motor 68 and consequently to position the car 14 relative to the horizontal pivot joint 34 is shown in block diagram form in FIG. 5. Motor operation is controlled in response to a level sensor 76 that produces a signal indicating the angle of inclination of the car 14 relative to vertical. The inclination signal is received by a motor control 78, which may be microprocessor-based. The control 78 causes the attitude or orientation of the car 14 as sensed by the level sensor 76 to be shown on a display 80, which may be a conventional cathode ray tube. Manual controls 82 permit the operator to actuate the motor control 78 to respond to a non-level condition.

The level sensor 76 may be a product supplied by Emaco (Canada) Ltd. and identified as "Electrolytic Title Sensor L-211U." The important characteristic of such a sensor is that the angle signal it produces is not responsive to centrifugal forces. Other appropriates sensors are known in the aircraft industry and are used to indicate the orientation of an aircraft during banking on turns. The level sensor 76 is fixed to the car 14, preferably at a position aligned with the horizontal pivot pin 54. The weight of the empty car 14 may be distributed such that its center of gravity 84 is normally in the central vertical plane of the car 14. The horizontal pivot axis 38 may also be in that central vertical plane when the horizontal pivot pin 54 is substantially centered in the two slots 64, 66 (as in the view of FIG. 4). Basically, the empty car 14 is then in a desired "level" orientation with no undesired inclination relative to vertical, and the level sensor 76 then produces a null signal indicating such orientation. The sensor 76 thereafter produces a signal indicating an inclination of the car 14 relative to vertical in response to two factors: first, an uneven distribution of weight in the car 14; second, sway of the car 14 in response to wind forces. These two separate conditions and compensation for them are illustrated in FIGS. **6*a*–6*b* and FIGS. 7*a*–7*b*. In reviewing those views and the description of control procedures that follows, it should be noted that the horizontal pivot axis 38 is coincident with the horizontal pivot pin 54** identified in those views.

Figure 6A:
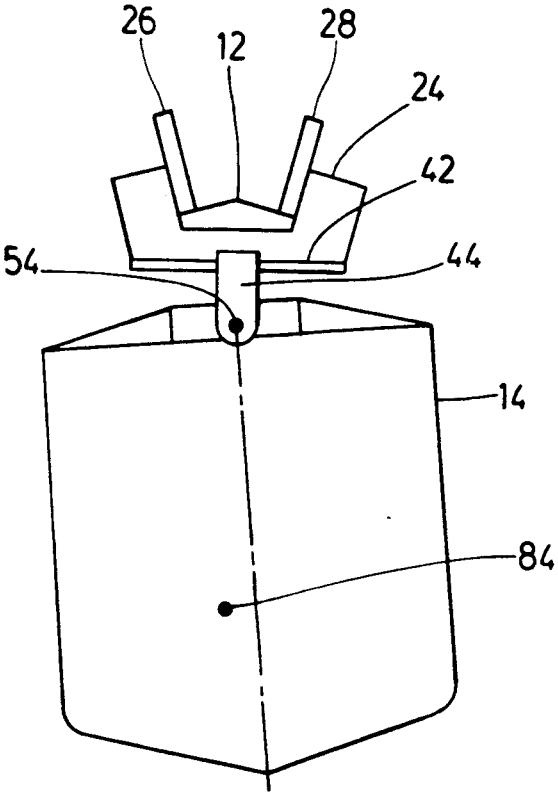
FIGS. 6*a* and 6*b* diagrammatically illustrate how the control system responds to an uneven distribution of weight within the car; and, FIGS. 7*a* and 7*b* diagrammatically illustrate how the control system responds to swaying of the car in response to wind.
Figure 6B:
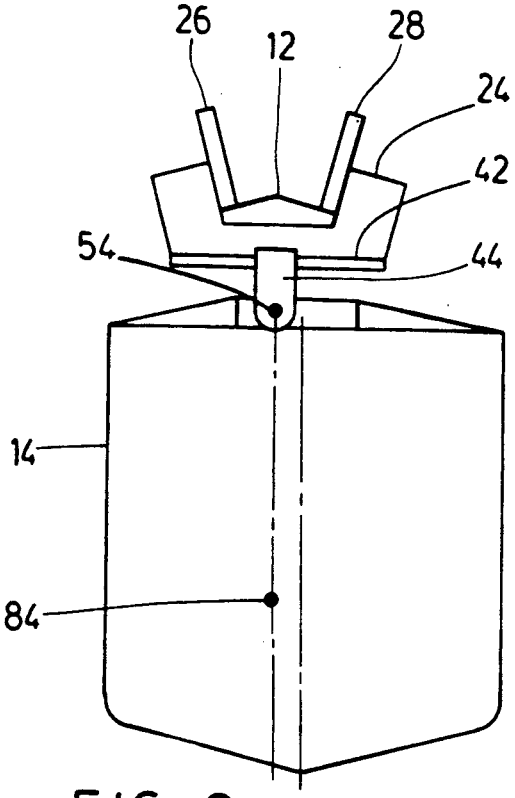

FIGS. **6*a* and 6*b* illustrate how the control system is used to respond to an uneven distribution of weight within the car 14. FIG. 6*a* indicates that the center of gravity 84 of the car 14 (including its contents) is offset from the central vertical plane of the car 14. The sensor 76 consequently produces a signal indicating a positive inclination of the car 14 relative to horizontal (positive versus negative inclination being arbitrarily designated). The motor control 78 causes the inclination of the car 14 to be shown on the display 80. An operator may trip the manual controls 82 enabling the motor control 78 to respond to the non-level condition. When allowed to respond, the motor control 78 actuates the motor 68 to rotate the threaded shaft 70 in an angular direction that produces a horizontal translation of the car 14 to the right (in the plane of FIGS. 6***a* and 6*b*). Gravity applies a torque to the car 14 that reduces the inclination of the car 14 relative to vertical (as in FIG. 6*b*). In response to a negative inclination, the motor control 78 may translate the car 14 to the left to compensate in a similar manner.

Figure 7A:
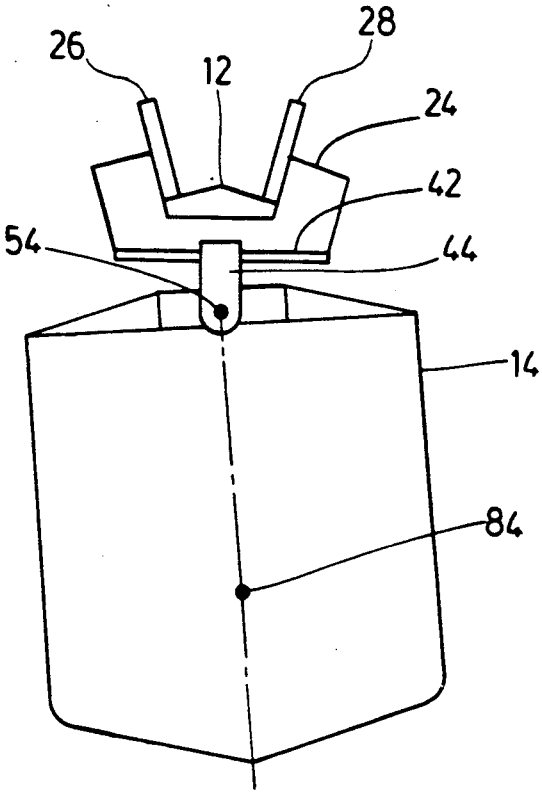
Figure 7B:
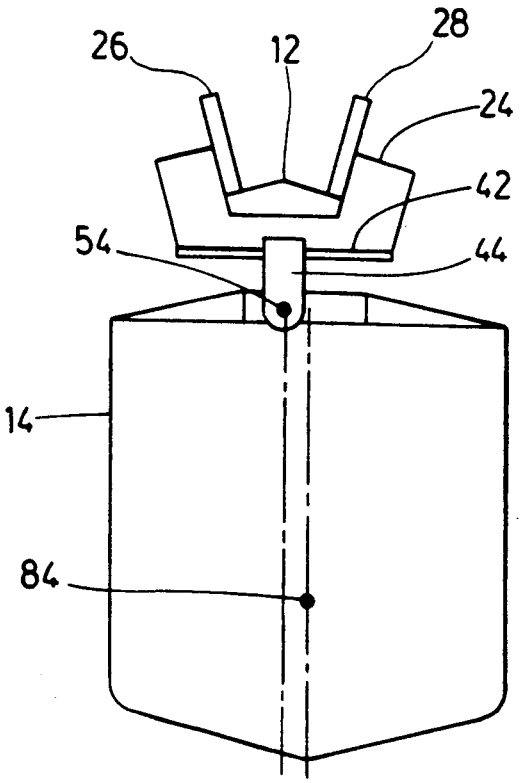

Operation of the controls in response to sway is illustrated in FIGS. 7*a* and 7*b*. The weight of the car 14 and its contents is assumed to be evenly distributed. The center of gravity 84 of the car 14 and its contents are consequently shown centered relative to the central plane of the car 14. Wind forces from the left are assumed to cause the car 14 to sway, producing once again a positive inclination relative to vertical, as in FIG. 7*a*. Since the inclination is not responsive to centrifugal forces, the sensor 76 produces a signal indicating the magnitude of the car's inclination. The motor control 78 displays the positive inclination on the level display 80. If the operator desires correction, that is, wind forces appear to be constant and fairly strong, he may then trip the manual controls 82 to allow the motor controller 78 to correct the orientation of the car 14. The motor controller 78 actuates the motor 68 to rotate the shaft 70 in the angular direction that displaces and translates horizontally the car 14 to the right, relative to the horizontal pivot joint 34. In this case, the centre of gravity 84 actually displaces relative to the pivot axis. Gravity produces a torque on the car 14 that resists the sway and effectively restores the car 14 to a level orientation as in FIG. 7*b*.

Although response to uneven weight distribution and sway have been treated separately above, it should be appreciated that these two condition can be handled simultaneously. The sensor 76 provides an inclination signal that reflects the combined effect of uneven weight distribution and sway. Displacing the car 14 in a direction which tends to null that signal compensates for both effects simultaneously.

One option is to allow the motor control 78 to operate automatically without operator intervention. In such circumstances, it is desirable to introduce a measure of hysteresis into the controls to avoid continuous triggering of the control mechanism in response to minor or temporary deviations in the orientation of the car 14. Since the car 14 in this embodiment is suspended with two carriages, the motor control 78 would effectively adjust the position of the car 14 simultaneously and equally relative to both carriages in response to the single signal from the sensor 76. The controls may also be adapted to display and regulate the orientation of multiple cars connected to one another, in an analogous manner.

It will be appreciated that a particular embodiment of the invention has been described and that modifications may be made therein without departing from the spirit of the invention or necessarily departing from the scope of the appended claims.

I claim:

1. A vehicle adapted for travel suspended below an overhead track, comprising:

a carriage;

means for mounting the carriage to the track for travel along the track with the carriage suspended below the track;

a container;

suspension means for suspending the container from the carriage, the suspension means comprising a pivot joint permitting the container to pivot about a generally horizontal pivot axis that aligns with the direction of an immediately overhead portion of the track, the pivot joint comprising connecting means connecting the container to the pivot joint and permitting horizontal translation of the container transverse to the horizontal pivot axis; and, controllable displacing means for displacing the container selectively in opposing horizontal directions, the displacing means cooperating with the connecting means during such displacing to translate the container horizontally and transversely relative to the pivot axis.

2. The vehicle of claim 1 in which:

the pivot joint comprises a pivot pin aligned with the horizontal pivot axis;

the connecting means comprise a pair of mounting structures attached to the pivot pin and a pair of support structures attached to the container, each of the support structures defining a slot transverse to the horizontal pivot axis that receives a different one of the pair of mounting structures for displacement along the slot.

3. The vehicle of claim 2 in which the displacing means comprise:

an elongate threaded shaft mounted on the container transverse to the pivot axis;

a motor mounted on the container and attached to the shaft to rotate the shaft; and a follower threaded to the shaft such that the follower displaces along the shaft in response to shaft rotation, the follower being attached to the pin in relative rotating relationship whereby displacement of the follower along the shaft displaces the container relative to the horizontal pivot axis.

4. The vehicle of claim 1 in which the suspension means comprise another pivot joint coupled in series to the pivot joint, the other pivot joint defining a generally vertical pivot axis and permitting the container to pivot about the generally vertical pivot axis.

5. The vehicle of claim 1, comprising:

sensor means for producing a signal corresponding to an angular component of the inclination of the container relative to vertical, the angular component being attributable to weight distribution within the container; and, control means for actuating the displacing means in response to the signal to translate the container relative to the horizontal pivot axis in a horizontal direction in which gravity applies a torque to the container that reduces the angular component.

6. The vehicle of claim 1 comprising:

sensor means adapted to produce a signal corresponding to an angular component of the inclination of the container relative to vertical, the angular component being attributable to sway of the container; and, control means for actuating the displacing means in response to the signal to translate the container relative to the horizontal pivot axis in a horizontal direction in which gravity applies a torque to the container that reduces the angular component.

7. The vehicle of claim 1 comprising:

sensor means adapted to produce a signal corresponding to angular components of the inclination of the container relative to vertical, the angular components being attributable to weight distribution within the container and to sway of the container; and, control means for actuating the displacing means in response to the signal to translate the container relative to the horizontal pivot axis in a horizontal direction in which gravity applies a torque to the container that reduces the angular components.

8. The vehicle of claim 7 in which the control means comprise display means for displaying inclination of the container and the control means permit manual actuation of the displacing means.

* * * * *